US006393740B1

(12) United States Patent
Rodriquez et al.

(10) Patent No.: US 6,393,740 B1
(45) **Date of Patent: *May 28, 2002**

(54) TEMPERATURE CONTROL AND DRIP VALVE ASSEMBLY FOR A STEAM IRON

(75) Inventors: Ramon R. Rodriquez, Richmond; Ronald G. Tynes, Glen Allen, both of VA (US); Kim F. Theusch, Woodbury, MN (US)

(73) Assignee: Hamilton Beach/Proctor-Silex, Inc., Glen Allen, VA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/388,237

(22) Filed: Sep. 1, 1999

(51) Int. Cl.[7] ..... D06F 75/26; D06F 75/18
(52) U.S. Cl. ..... 38/77.7; 38/77.8
(58) Field of Search ..... 38/77.7, 77.8, 38/77.83, 82; 219/250, 254

(56) References Cited

U.S. PATENT DOCUMENTS

| | | | | | |
|---|---|---|---|---|---|
| 2,342,653 | A | * | 2/1944 | Edwards | 38/77.7 |
| 3,136,080 | A | * | 6/1964 | Albrecht | 38/77.7 |
| 3,165,843 | A | * | 1/1965 | Willman | 38/77.81 |
| 3,305,211 | A | * | 2/1967 | Phillips | 251/209 X |
| 4,296,560 | A | * | 10/1981 | Schwob | 38/77.83 |
| 4,627,181 | A | * | 12/1986 | Bastida | 38/77.7 |
| 5,531,037 | A | * | 7/1996 | Pons et al. | 38/77.8 |
| 5,572,810 | A | * | 11/1996 | Farrington | 38/77.7 |
| 5,829,175 | A | | 11/1998 | Marchetti et al. | |

FOREIGN PATENT DOCUMENTS

FR 2337780 * 11/1976

* cited by examiner

*Primary Examiner*—Ismael Izaguirre
(74) *Attorney, Agent, or Firm*—Roger S. Dybvig

(57) ABSTRACT

An improved temperature control and drip valve assembly which provides for a positive control of the amount of water introduced into the steam chamber of a steam iron in relation to the temperature setting of the steam iron. A self-cleaning capability is provided for flushing the steam chamber and its steam vents.

3 Claims, 3 Drawing Sheets

10
26
30
22
28
21
18
16
12

30
26
24
48
66
10
22
64
18
20
36
34
62
28
38
64
21
40
46
62A
44
42
16
32
35
12
14

30
26
56
46
52
58
38
36
88
90
50
60
40
81
70
54
76
78
92
65
72
62
80
67
66
84
82
34
64
74
35
8

TEMPERATURE CONTROL AND DRIP VALVE ASSEMBLY FOR A STEAM IRON

FIELD OF THE INVENTION

This invention relates to a temperature control and drip valve assembly for a steam iron. This invention is primarily concerned with household steam irons but aspects of the invention may be useful in other applications.

BACKGROUND OF THE INVENTION

Steam is created in a steam chamber of a steam iron by passing water through a drip valve onto the heated soleplate of the iron. Because different temperatures are required for satisfactory pressing of different fabrics, steam irons are provided with thermostats for adjusting the heat output of the heating element that heats the soleplate. A steam iron is incapable of producing steam at lower temperature levels and can produce increasing amounts of steam as the temperature levels increase. Because there is a correlation between the temperature of the soleplate and the amount of water which should be introduced into the steam chamber to produce steam satisfactory for ironing which is neither superheated and dry or unduly wet, steam irons are provided with mechanisms for varying the amount of water introduced into the steam chamber in accordance with the temperature settings of the heating element. These mechanisms also ensure that water will not be introduced into the steam chamber if the soleplate is insufficiently hot to produce steam. There is an ever-present need to provide improved assemblies for controlling the amount of steam produced, if any, relative to the temperature setting of the heating element.

SUMMARY OF THE INVENTION

This invention provides an improved temperature control and drip valve assembly for a steam iron.

An object of this invention is to provide an improved temperature control and drip valve assembly which provides for a positive control of the amount of water introduced into the steam chamber of a steam iron in relation to the temperature setting of the steam iron.

A temperature control in accordance with this invention includes a rotatable temperature control knob, a rotatable drive member connected to said knob for rotation therewith, and a thermostat having a rotatable temperature adjusting shaft connected to the drive member for rotation therewith. Rotation of the control knob can thereby be used to control the temperature generated by the heating element.

Further in accordance with this invention, the control knob has a vertical shaft having a downwardly-facing shoulder and the drive member has an upwardly facing shoulder confronting the downwardly-facing shoulder. The shoulders have complementary cam surfaces engaged by a cam follower which is integral with a vertically movable valve stem which has a lower end that cooperates with a valve seal to control the amount of water permitted to drip from a water reservoir into the steam chamber. Accordingly, rotary movements of the control knob to control the temperature generated by the heating element are also transmitted to vertical movements of the valve stem.

Further in accordance with this invention, a self-cleaning capability is provided for flushing the steam chamber and its steam vents by fully opening the valve port so that the steam chamber can be filled with water from the water reservoir. To this end, the control knob is vertically movable relative to said drive member through a limited distance which is sufficient to fully open the valve port, as will be described further below.

Other objects and advantages will become apparent from the following description and the drawings.

DETAILED DESCRIPTION

Figure 1:
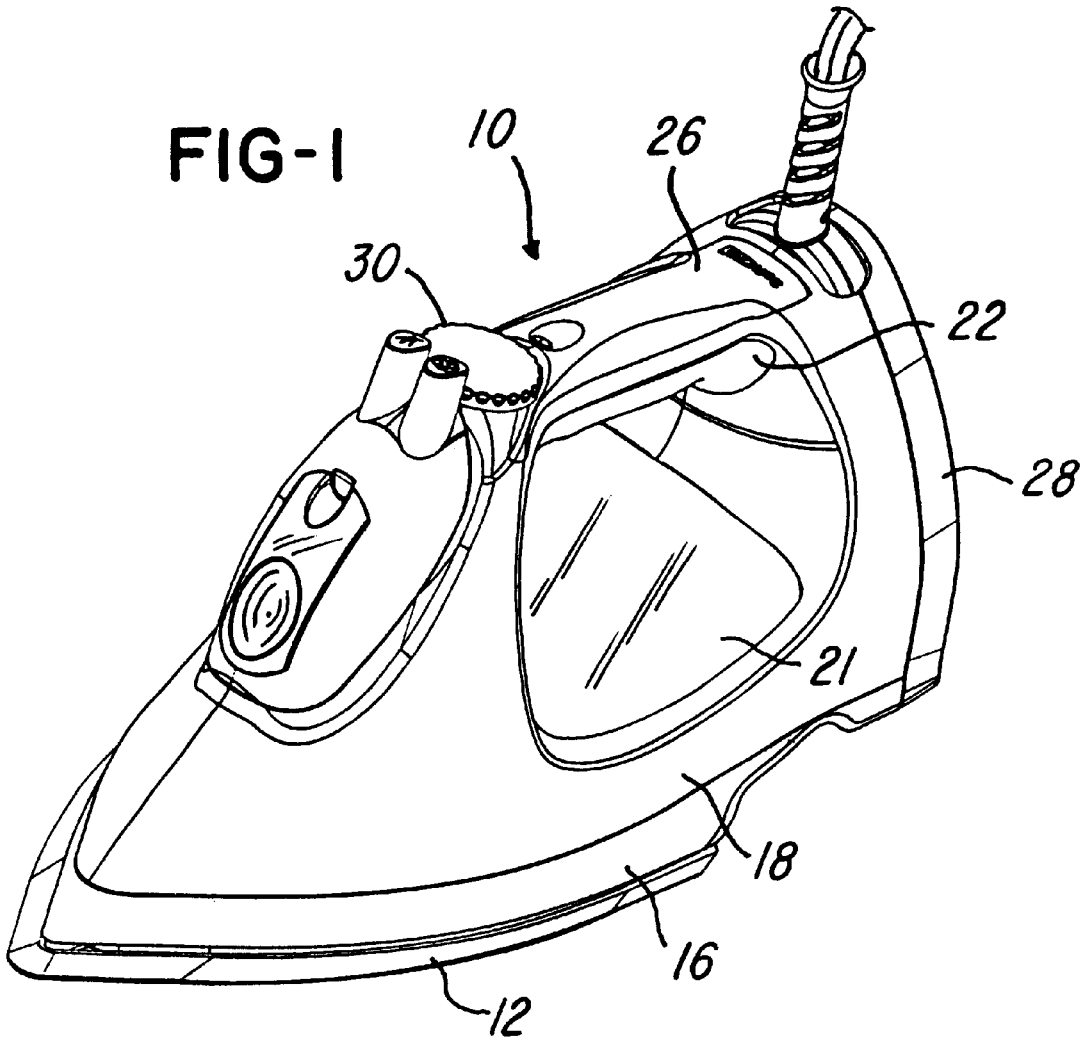
FIG. 1 is a perspective view of a steam iron made in accordance with this invention.
Figure 2:
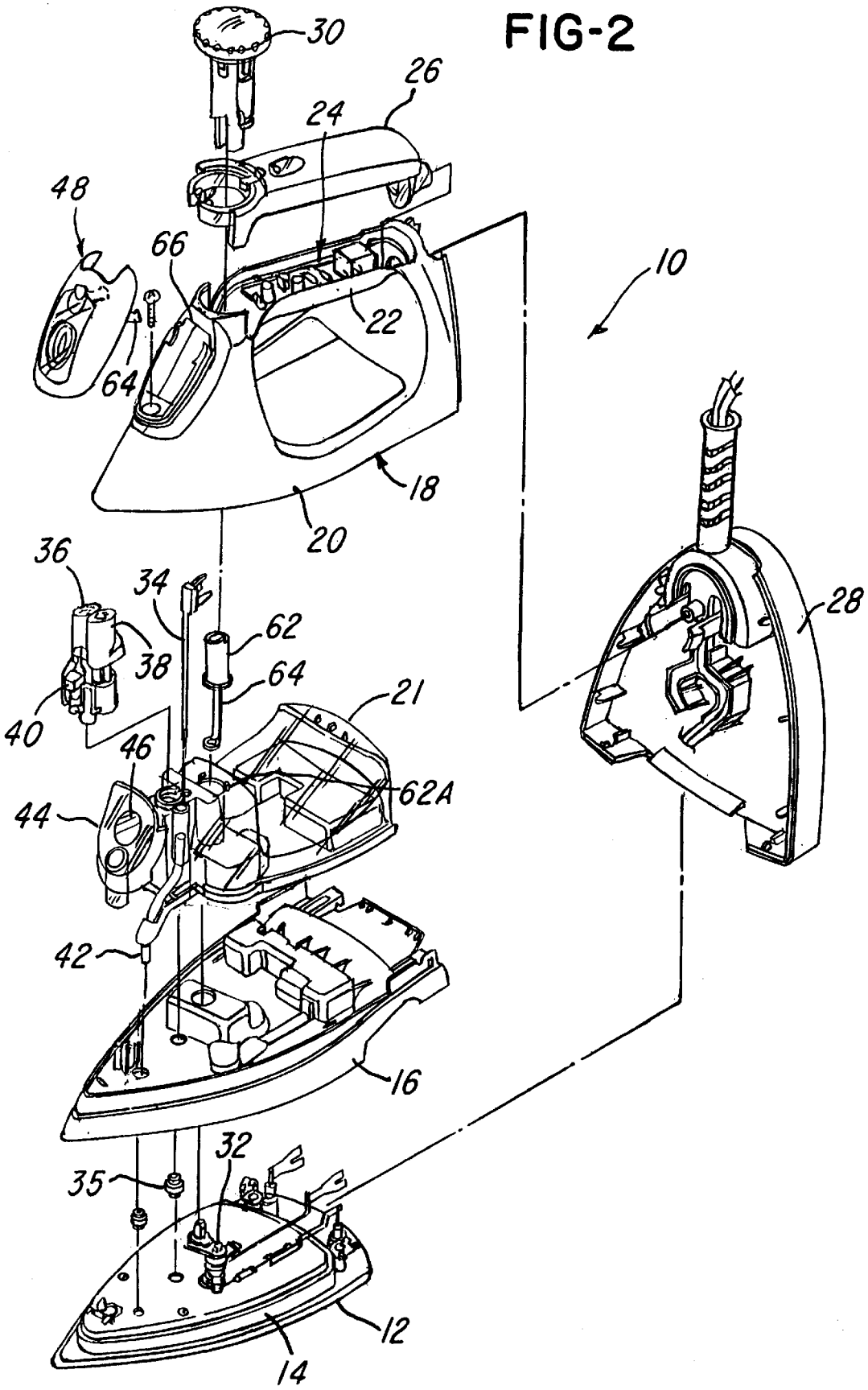
FIG. 2 is an exploded isometric view of the iron of FIG. 1.

With reference to FIGS. 1 and 2, the present invention is illustrated in connection with a household steam iron, generally designated 10, having a soleplate 12 with a steam chamber 14, covered by a base cover 16 which supports a handle 18. Handle 18 has a lower portion 20 which confines a water reservoir 21 and an upper portion 22 which receives an electronic control module 24 and which is covered by a top cover 26. The handle upper portion 22 and the top cover 26 constitute a handgrip. In addition, the iron 10 includes a rear cover 28, temperature control knob 30 for setting a thermostat 32 mounted on the soleplate 12, and a drip valve assembly including a drip valve stem 34 for dripping controlled quantities of water into the steam chamber 14 through a drip valve seal 35. As well known, the water dripped into the steam chamber 14 is heated by an electrical heating element in the soleplate 12, vaporizes and forms steam which exits from the soleplate 12 through plural steam vents (not shown). The heating element and the electronic controls are connected to house current by means of a power cord connected to the rear cover 28. The particular iron 10 shown in the drawings also has a pair of manually-operable pistons 36 and 38, respectively used to spray water forwardly of the iron through a nozzle 40 and to create a burst of steam by pumping water by way of a thermoplastic tube connection 42 into the steam chamber 14.

The water reservoir 21 has a forwardly projecting, concave front face 44 and a water conduit 46 extending from the front face 44 into the hollow interior of the reservoir 21. A fill port assembly, generally designated 48, is used to enable one to pour water into the water reservoir 21 and also to cover the water conduit 46 during normal use of the iron to prevent contaminants from entering into the reservoir 21.

Figures 3, 4, 5, 6, 7, 8, 9:
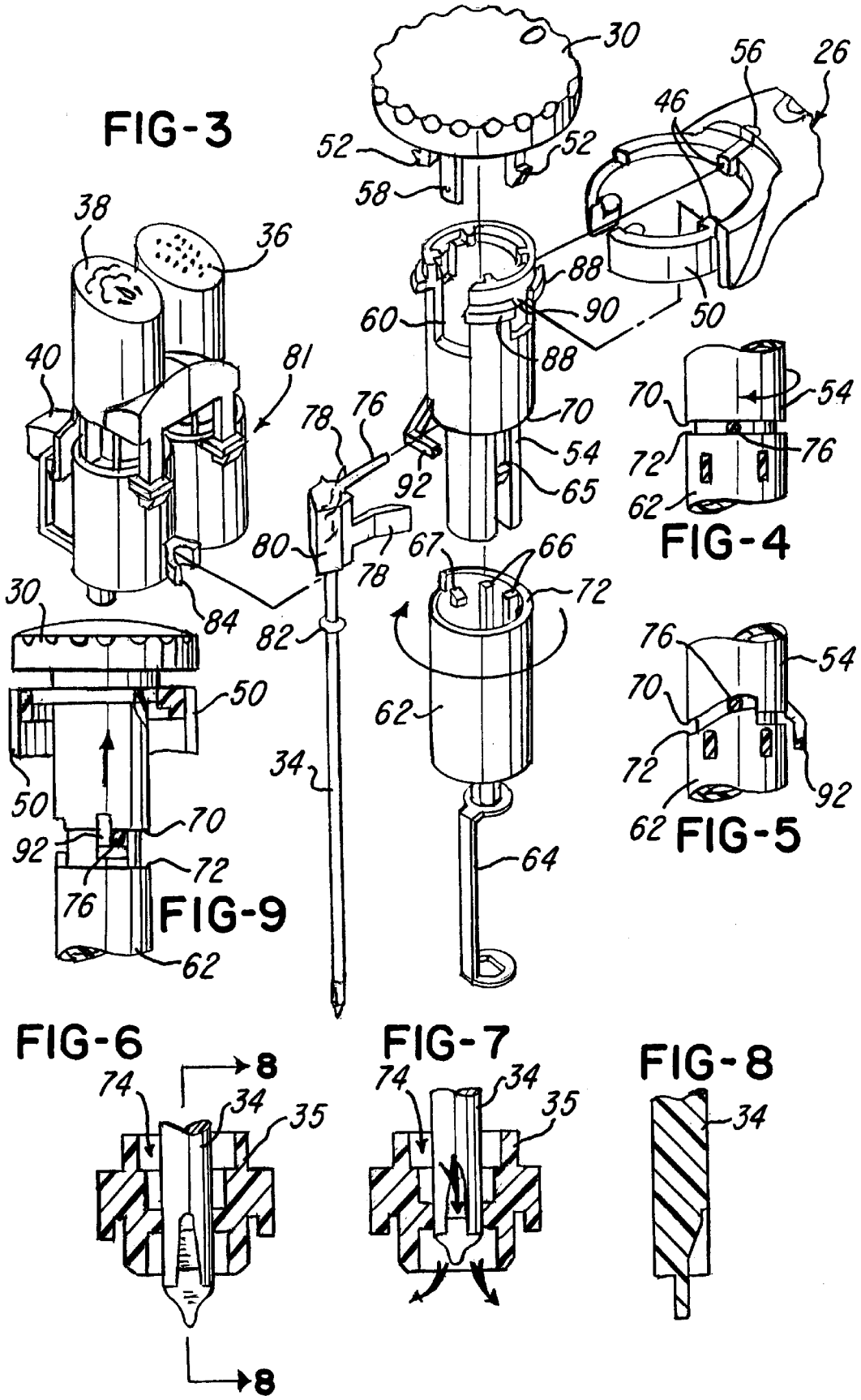
FIG. 3 is an exploded isometric view of parts of a temperature control and drip valve assembly and including parts of a spray and steam pump assembly which forms part of the iron of FIG. 1.
FIGS. 4 and 5 are fragmentary elevational views illustrating the operation of a cam and a cam follower in controlling the vertical location of the valve stem.
FIGS. 6 and 7 are fragmentary cross-sectional views of the valve seal and the valve stem to illustrate the operation of the valve.
FIG. 8 is a fragmentary cross-sectional view of the lower portion of the valve stem taken along line 8—8 of FIG. 6.
FIG. 9 is fragmentary view, partly in cross section, showing the raising of the cam follower for self-cleaning purposes.

With reference to FIG. 3, the temperature control knob 30 is mounted for rotation on a bearing 50 formed at the front end of the top cover 26 and has plural hooks 52 which extend into engagement with openings in a hollow control knob shaft 54 that is normally located below the bearing 50. The knob 30 has an "off" or "0" mark which, when the knob 30 is rotated to a position in which the thermostat 32 prevents energization of the heating element 15, is aligned with an indicator 56 on the top cover 26. The proper orientation of the knob 30 is assured by means of a depending rod 58 that must be aligned with an opening 60 in the upper sidewall of the knob shaft 30. The lower end of the knob shaft 54 extends into the hollow upper end of a rotatable drive member 62 and is connected to the knob shaft 54 for rotation therewith. The drive member 62 is rotatably mounted on the water reservoir 21 by hooks 62A(FIG. 2). The drive member 62 in turn is connected by a metal connecting member 64 to an adjusting shaft forming part of the thermostat 32 in order to adjust the thermostat 32 to the desired heat level.

Relative rotation between the knob shaft 54 and the drive member 62 is prevented by the engagement between ribs 66 inside the hollow interior of the drive member 62 and a complimentary surface of the knob shaft 54. The drive member 62 is connected to the knob shaft 54 by a pair of hook arms 65 (only one of which is shown in FIG. 3) that engage beneath a pair of diametrically opposed tabs 67 inside the upper end of the drive member 62 (again only one tab being shown in FIG. 3). This construction allows for the knob 30 and its shaft 54 to be raised relative to the drive member 62 for self-cleaning purposes, as will be described below.

The knob shaft 54 has a downwardly-facing shoulder 70 and the drive member 62 has an upwardly-facing shoulder 72 confronting the downwardly-facing shoulder 70. The shoulders 70 and 72 have complementary cam surfaces which control the vertical height of the valve stem 34 as will now be described.

With reference to FIGS. 6, 7 and 8, the valve stem 34 is molded in one piece and has a lower end which comprises a cylindrical body of a size to close the port in the valve seal 35 and a downwardly-extending notch or recess 74 of increasing dimension. As is apparent, the valve stem 34, when lowered as shown in FIG. 6, fully closes the port in the valve seal 35 and opens the port by increasing degrees when the valve stem 34 is raised. The upper end of the valve stem 34 comprises an integral cam follower 76 that extends into the space between the shoulders 70 and 72, an integral pair of arms 78 that engage the outer surface of the drive member 62 to prevent the valve stem 34 from rotating, and an integral triangular rear portion 80 that engages between the cylinder portions of the pump housing 81 so that the head of the valve stem 34 is always held in a position in which the cam follower 76 extends between the shoulders 70 and 72.

FIGS. 4 and 5 show how rotation of the temperature control knob shaft 54 controls the height of the valve stem cam follower 76. As shown in FIG. 4, there is a substantial length of the shoulders 70 and 72 which have no contour which would raise or lower the valve stem 34. This is because the seal port is not opened until the temperature setting is sufficiently high to create steam. FIG. 5 shows a condition in which the valve stem follower 76 is raised to cause the valve stem 34 to be raised to create the condition shown in FIG. 7 in which water is dripped from the water reservoir 21 into the steam chamber.

A valve stem seal 82 is shown in FIG. 3. This bears against the top portion of the water reservoir 21 through which the valve stem 34 extends. A U-shaped clamp 84 on the pump housing 81 holds the seal 82 in sealing relation to the water reservoir 21.

In most positions of the temperature control knob 30, the knob shaft 54 is prevented from being raised into the bearing 50 at the front of the top cover 26 by means of stop members 86 in the bearing 50 that engage a flange 88 on the outside of the knob shaft 54. However, when the temperature control knob 30 is set to the "0" position, gaps 90 in the flange 88 are aligned with the stop members 86 so that the knob 30 can be elevated as shown in FIG. 9. At the "0" position of the knob shaft 54, a finger 92 on the knob shaft 54 engages under the cam follower 76, so that the raising of the temperature control knob is accompanied by the raising of the valve stem 34, and a corresponding full opening of the seal port. This operation can be used for self-cleaning of the soleplate as mentioned above.

Although the presently preferred embodiment of this invention has been described, it will be understood that within the purview of the invention various changes may be made within the scope of the following claims.

Having thus described our invention, we claim:

1. A temperature control and drip valve assembly for a steam iron comprising:

a temperature control including a rotatable temperature control knob, a rotatable drive member connected to said knob for rotation therewith, a thermostat having a rotatable temperature adjusting shaft connected to said drive member for rotation therewith, said knob having a vertical shaft having a downwardly-facing shoulder, said drive member having an upwardly facing shoulder confronting said downwardly-facing shoulder, said shoulders having complementary cam surfaces; and a drip valve assembly including a valve seal having a port centered on a vertical axis, a valve stem confined for vertical movement adjacent said drive member along said vertical axis, a cam follower integral with said valve stem and confined between said upwardly facing shoulder and said downwardly facing shoulder so that said valve stem can be moved vertically up and down relative to said valve seal in response to rotation of said knob.

2. The assembly of claim 1 wherein said valve stem has lower end received in said valve seal, said lower end having a cylindrical body of a size to close said port when said valve stem is lowered so that said notch is at least partly below said port and to open said port by varying amounts as said valve stem is raised.

3. The assembly of claim 1 wherein said control knob is vertically movable relative to said drive member through a limited distance, wherein said knob is mounted for rotation on a bearing, said bearing having at least one stop surface and said knob having a flange which has at least one opening which is sufficiently large to receive said at least said one stop surface so that said knob can be raised relative to said drive member when said at least one opening is aligned with said stop surface; said knob having a finger that moves under said cam follower when said opening in said flange is aligned with said stop surface so that said valve stem may be elevated relative to fully open said port by when the control knob is raised.

* * * * *